US006831880B1

(12) United States Patent
Ziegler

(10) Patent No.: US 6,831,880 B1
(45) Date of Patent: Dec. 14, 2004

(54) BOWLING BALL SLICE DISPLAY FACE

(76) Inventor: William Ziegler, 616 S. Ceadar Bluff Rd., Knoxville, TN (US) 37922

( * ) Notice: Subject to any disclaimer, the term of this patent is extended or adjusted under 35 U.S.C. 154(b) by 101 days.

(21) Appl. No.: 09/741,939

(22) Filed: Dec. 21, 2000

(51) Int. Cl.[7] ..... G04B 19/04

(52) U.S. Cl. ..... 368/223; 368/228; 368/238

(58) Field of Search ..... 368/10, 223, 226, 368/285, 232, 88, 276; D10/1, 123, 126, 6; 40/327

(56) References Cited

U.S. PATENT DOCUMENTS

| | | | | | |
|---|---|---|---|---|---|
| D131,685 | S | * | 3/1942 | Goldberg | D10/126 |
| D163,416 | S | * | 5/1951 | Punzak | D10/6 |
| D195,982 | S | * | 8/1963 | Hadley | D10/1 |
| 3,811,211 | A | * | 5/1974 | Morgan | 40/327 |
| 3,815,570 | A | | 6/1974 | Story | 125/14 |
| 3,840,000 | A | | 10/1974 | Bible | 125/35 |
| 3,879,876 | A | * | 4/1975 | Morgan | 40/327 |
| D274,986 | S | * | 8/1984 | Mermelstein | D10/1 |
| 4,624,579 | A | * | 11/1986 | Forman | 368/88 |
| D287,940 | S | | 1/1987 | DeGroff | D10/6 |
| 5,109,635 | A | * | 5/1992 | Inzerillo et al. | 368/232 |
| 5,754,499 | A | | 5/1998 | Lin | 368/88 |
| 5,964,263 | A | | 10/1999 | Nelson | 144/329 |

FOREIGN PATENT DOCUMENTS

| | | | | |
|---|---|---|---|---|
| JP | 405264748 | * | 10/1993 | 368/227 |

OTHER PUBLICATIONS www.hhpens.safeshopper.com, H&H Pens Company, Beautiful Writing Instruments Made From Bowling Balls, No Date Avail.*

* cited by examiner

*Primary Examiner*—Kamand Cuneo
*Assistant Examiner*—Jeanne-Marguerite Goodwin
(74) *Attorney, Agent, or Firm*—Michael F. Petock, Esq.

(57) ABSTRACT

A display face is created by cutting or slicing a bowling ball wherein a portion of a weight block or core center of the bowling ball is displayed. The weight block or core is different in different balls. Accordingly, a slice of the bowling ball with the weight block therein creates a novel or unique appearance on the display face. The unique display face may be provided with clock hands and indicia representing clock numerals mounted in front of the bowling ball slice. Alternatively, the bowling ball slice may be utilized as a plaque on which an award plate is mounted or on which indicia are engraved. The display face may not contain a portion of the weight block or center core where slices taken from the periphery of the bowling ball or taken from a bowling ball without a weight block or center core. Additionally, the bowling ball may be provided with a fragrance to create a scent, and this fragrance a scent may also be associated with the display face. Certain bowling balls are also provided with particles which emit visible light upon being irradiated. Depending on whether the particles are distributed only through the periphery or throughout, the irradiation of a display face, usually with black light, will produce visible light or florescence either on the periphery of the display face or throughout the display face. The peripheral edge of the display may also be shaped.

34 Claims, 3 Drawing Sheets

FIG. 4
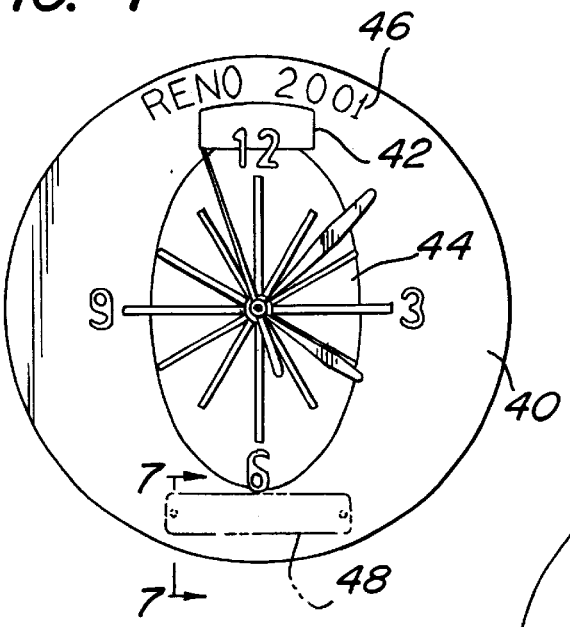
FIG. 5
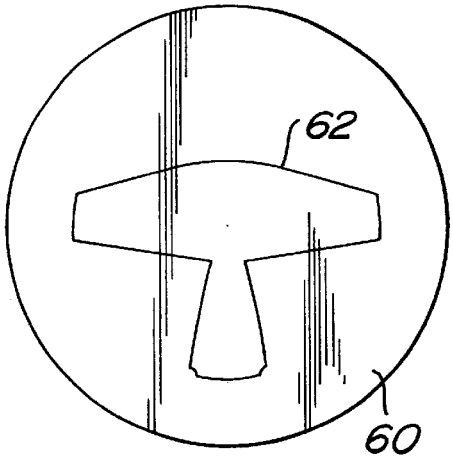
FIG. 6
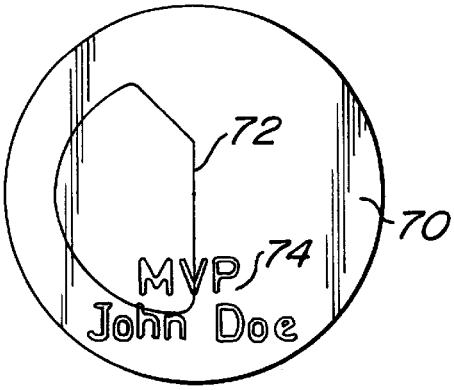
FIG. 8
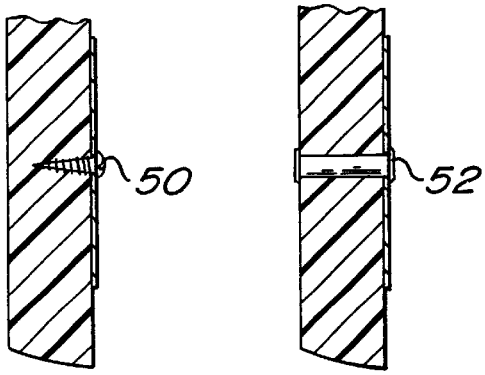
FIG. 7

FIG. 9
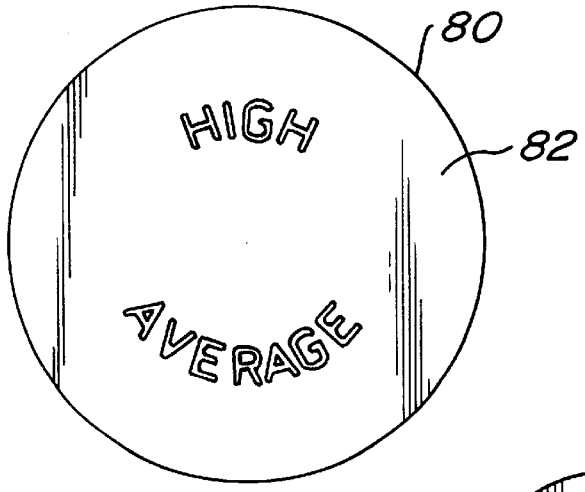
FIG. 10
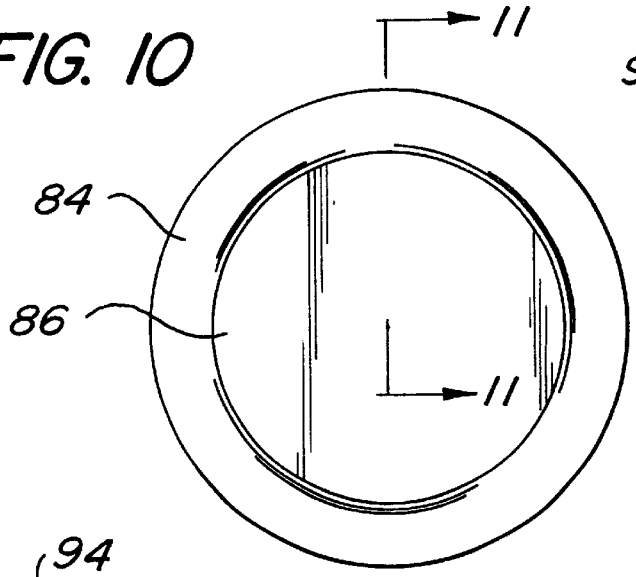
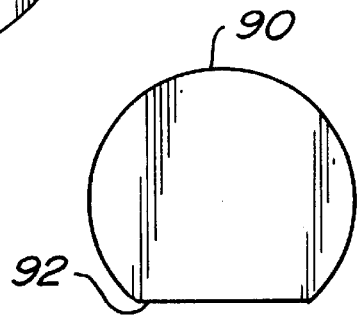
FIG. 12
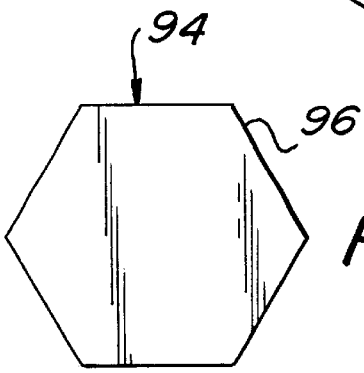
FIG. 13
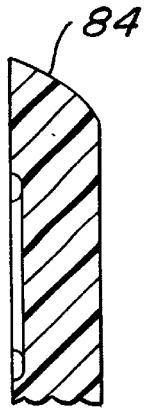
FIG. 11

BOWLING BALL SLICE DISPLAY FACE

FIELD OF THE INVENTION

The present invention relates to display faces. More particularly, the present invention relates to display faces which may be utilized for clock faces, plaques or other ornamental purposes.

BACKGROUND OF THE INVENTION

Clock faces, plaques and other display face ornamentation are widely used. Novel display faces are desirable.

SUMMARY OF THE INVENTION

Briefly and basically, in accordance with the present invention, a display face is created by cutting or slicing a bowling ball wherein a portion of a weight block or a core center of the bowling ball is displayed. The weight block or core is different in different balls. Accordingly, a slice of the bowling ball with the weight block therein creates a novel or unique appearance on the display face.

The unique display face may be provided with clock hands and indicia representing clock numerals mounted in front of the bowling ball slice. Alternatively, the bowling ball slice may be utilized as a plaque on which an award plate is mounted or on which indicia are engraved. The award plate may be mounted by any suitable means including threaded fasteners, rivets or adhesive. The engraved indicia may be at least partially filled with various pigments to provide a desired color, such as black, gold or silver.

Additionally, display faces may be created in bowling balls by producing a bowling ball slice through a portion which does not have a weight block or center core, either because the slice is taken more towards the periphery where the weight block does not exist or possibly a ball without a weight block. Additionally, the composition of the bowling ball may be scented with a fragrance, such as a plum fragrance. Further, a bowling ball may be comprised of or contain particles either about the periphery or throughout the bowling ball which cause the bowling ball to glow in black light. Black light is understood to be invisible ultraviolet or infrared radiation. Black light may be used to cause florescent materials to emit visible light.

Additionally, the circumferential edge of the display face may be provided with various shapes.

BRIEF DESCRIPTION OF THE DRAWINGS

For the purpose of illustrating the invention, there are shown in the drawings forms which are presently preferred; it being understood, however, that this invention is not limited to the precise arrangements and instrumentalities shown.

FIG. 4 is a front elevation view of another display face in accordance with the present invention utilized as a clock face and combined award plaque.

FIG. 5 is a front elevation view of a display face in accordance with the present invention illustrating another weight block or core center.

FIG. 6 is a front elevation view illustrating another design formed by slicing through a bowling ball containing a weight block or core center which contains engraving thereon for use as an award plaque.

FIG. 7 is a cross-sectional view taken along line 7—7 of FIG. 4 illustrating one method of attaching an award plate.

FIG. 8 is a cross-sectional view illustrating another method of attaching of an award plate.

FIG. 9 is a front elevation view of another embodiment of the present invention illustrating engraving on a display face made from a slice of a bowling ball without or where there is no weight block or core center.

FIG. 10 is a rear elevation view of the embodiment of FIG. 9.

FIG. 11 is a broken away cross-sectional view through a portion of the embodiment of FIGS. 9 and 10 taken along line 11—11 of FIG. 10.

FIG. 12 is a front elevation view of a display face in accordance with another embodiment of the present invention wherein the circumferential edge is provided with a special shape.

FIG. 13 is a front elevation view of another embodiment illustrating another one of many possible peripheral or circumferential edge shapings.

DETAILED DESCRIPTION OF THE PREFERRED EMBODIMENTS

Figure 1:
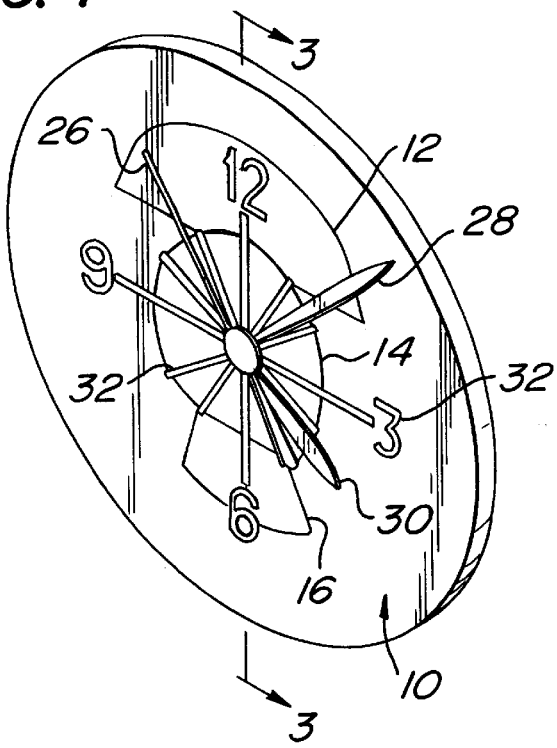
FIG. 1 is a view in perspective of a display face in accordance with the present invention utilized as a clock face.

Referring to the drawings, wherein like numerals indicate like elements, there is shown in FIG. 1 a display face 10 comprised of a slice of a bowling ball wherein a portion of a weight block or core center of the bowling ball is displayed. The slice of the bowling ball may be constructed by cutting a bowling ball with a diamond saw blade or any other suitable cutting apparatus. The bowling ball may be any bowling ball, including, but not limited to, a used bowling ball, a surplus bowling ball or a new bowling ball. Although it is presently preferred that standard size bowling balls be used for this purpose, it may be used with any size bowling ball including smaller balls used with duckpin bowling. Bowling balls are provided with weight blocks or core centers of various shape for the purpose of controlling or influencing the way a bowling ball rolls down a bowling alley. There are numerous different shapes of weight blocks or core centers being utilized and new ones are being continuously created and utilized. Although the present invention may well find a supply of bowling balls from used bowling balls which have no further use or surplus bowling balls as a means of disposing of them, the present invention may be utilized on a production basis by cutting or slicing new, unused bowling balls. Once the bowling ball is cut into slices, the surfaces of the slices may be sanded to polish the surface. The display face surface may be finished with wax, polyurethane or shellac. Finishing with wax is presently preferred.

Figure 3:
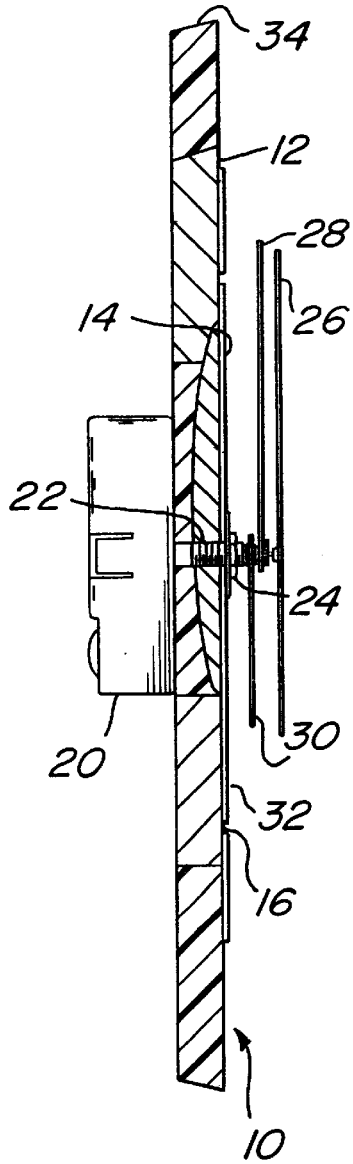
FIG. 3 is a cross-sectional view taken along line 3—3 of FIG. 1.
Figure 2:
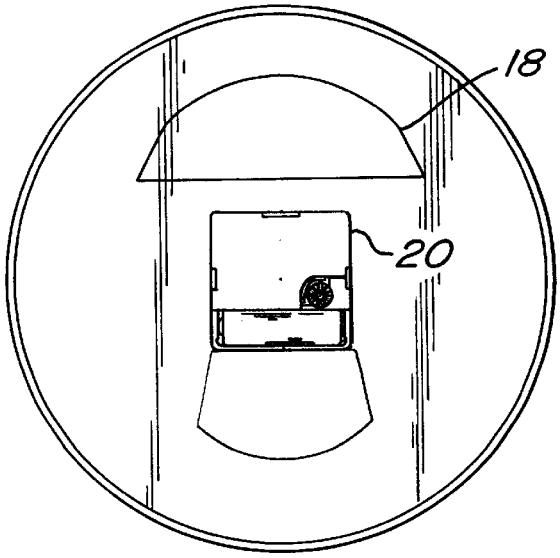
FIG. 2 is an elevation view of the backside of FIG. 1.

Referring now to FIGS. 1, 2 and 3, wherein like numerals indicate like elements, there is shown on display face 10 portions 12, 14 and 16 of a weight block or core which has been sliced at a particular location. Each slice taken at a different location, even on the same ball, produces a different pattern. For example, it is noted that the backside of FIG. 1 as illustrated in FIG. 2 presents a somewhat different pattern because the backside has been cut a distance of approximately ½ inch to 1 inch away from the cut that formed the front face. The illustrated or stated thickness is merely a presently preferred illustration and any suitable thickness may be utilized. For example, pattern 18 is slightly different from 12. Note that the lower edge in 18 is straight whereas it is indented in 12. There are also other differences including size. The pattern 14 on the front face is not projected on the rear as shown in FIG. 2.

A housing 20 for the clock motor, battery and gearing is shown in FIGS. 2 and 3. This is attached to display face 10 by a threaded shaft 22 mounted through a hole drilled in display face 10. The threaded shaft is secured by nut 24. The clock itself has a second hand 26, a minute hand 28 and an hour hand 30. Suitable indicia of a clock face are also mounted on the front of the display by means of nut 24 on shaft 22. These indicia in the example illustrated are the numerals 3, 6, 9 and 12 with projections for the missing numerals as illustrated in FIG. 1 at 32. However, any suitable clock indicia may be utilized.

As may be best seen in FIG. 3, the edge of display face 10 may be curvedly tapered at 34. If display face 10 is centered on a diameter of the bowling ball, the edge 34 would be merely rounded, but once it is off center of the bowling ball, it would become a slightly rounded slanted edge as shown in FIG. 3.

Referring now to FIG. 4, there is shown another embodiment of the present invention in the form of a display face 40 displaying a section of the weight block or core elements 42 and 44. Display face 40 may have a clock mounted thereon similar to that shown with respect to the embodiment of FIGS. 1-3. However, it is understood that any suitable clockworks may be utilized, although a battery driven DC clock is currently preferred, the clock may be run off of an AC current conventionally available, be manually windable or of any other suitable clockworks.

As illustrated in FIG. 4, display face 40 may be utilized as a combined clock and award plaque. There is shown in FIG. 4 engraving 46 which is illustrated solely for the purposes of illustration to be "RENO 2001" representing a bowling event which will take place in Reno, Nev. in the year 2001. However, any suitable notation may be engraved on any suitable location of the display face. Additionally or alternatively, an award plate may be mounted to the face of the display face by adhesive, screws, rivets or any other suitable fastening means. There is shown in FIG. 4 an awards plate 48 mounted to the front of display face 40 which may have engraving or other suitable markings thereon. As may be seen in the cross-sectional view of FIG. 7, award plate 48 may be mounted by a suitable screw or other threaded fastener 50. The threaded fastener may be a bolt which goes completely through display face 40. Alternatively or additionally, adhesive may be provided between award plate 48 and the face of display face 40. The award plate may be mounted either solely with adhesive or with a combination of adhesive and other fastener. FIG. 8 illustrates an alternative embodiment of the fastener wherein a rivet 52 is utilized.

Referring to FIG. 5 there is shown a display face 60 which illustrates another different shape formed by a weight block 62.

Referring to FIG. 6, there is shown a display face 70 with another illustration of a cross section through a weight block 72 illustrating another one of the varied shapes. As stated above, there are a large number of weight blocks in use and new ones are being developed each year. These shapes vary significantly in different balls. Further, depending upon where the slice is taken and the direction of the slice through the ball, a different pattern is created on the face of the display face. This creates a unique and appeasing appearance, which is of particular moment to bowlers and others having an interest in bowling and bowling balls.

There is also illustrated on display face 70 in FIG. 6 engraving 74 in the form of "MVP John Doe" for most valuable player John Doe. In all of the engravings in the various embodiments, the engraving may or may not be provided with a pigment as desired. Any suitable pigment may be utilized such as black, gold, silver or any other suitable pigment.

FIGS. 9, 10 and 11 illustrate an embodiment of the invention wherein the bowling ball slice is taken through a portion of a bowling ball not having a weight block or core center. For example, there is shown in FIG. 9 a bowling ball slice 80 having a display face 82 with the words "High Average" engraved thereon. As may be seen from FIGS. 10 and 11, this slice is taken near the periphery of a bowling ball, with a curved portion 84 as illustrated in FIGS. 10 and 11. The back flat portion is shown at 86. A display face not having a weight block or core center may be as described taken from a peripheral cut, as contrasted to a center cut or it may be taken from a bowling ball not having a weight block or core center.

FIG. 12 illustrates an embodiment of the invention wherein the bowling ball slice 90 is provided with one of many possible circumferential edge shapings. In the present case, the lower portion 92 of the face is flattened. This may be provided for aesthetic purposes, or to enable it to stand on a flat surface. A flat surface may be created solely for aesthetic reasons or it may have been cut in this manner to cut out a portion of the slice of the ball where the finger holes of the bowling ball were located.

FIG. 13 illustrates merely another form of peripheral or circumferential shaping, in this case in the form of a hexagon. Bowling ball slice 94 is provided with shaping about its periphery to form six flat surfaces 96 to form a hexagon as illustrated. However, it is understood that any type of peripheral or circumferential shaping may be provided on the bowling ball slices, including, but not limited to, triangular, square, octagon, decagon, oval or any other desired shaping of the circumference or periphery of the display face. Further, FIGS. 12 and 13 do not represent any particular scale, nor in reference to the size of any of the other figures. These may be of any size depending upon the size of the ball and the amount of circumferential or peripheral shaping. Further, the edge or the entire front surface of the display face of any of the embodiments may be provided with embellishment or fanciful details ground or engraved therein.

In any of the embodiments illustrated, the bowling ball from which the slices are cut may be provided with a fragrance to produce a scent. This would then produce a display face with a scent. One common scent which may be used is that of plum. However, any suitable fragrance or scent may be used.

The bowling ball from which the slices are taken may be provided with particles which emit visible light under black light or any suitable radiation. The particles may be distributed around the periphery of the bowling ball or throughout the bowling ball. If the particles are distributed only about the periphery of the bowling ball, there will be a circumferential ring produced on the display face when irradiated. If the particles are distributed throughout the bowling ball, then the entire display face will produce visible light when irradiated. Black light is invisible ultraviolet or infrared radiation which causes fluorescent materials to emit visible light. However, as indicated above, any suitable type of radiation may be utilized in connection with particle which emit visible light when irradiated by that radiation.

The present invention may be embodied in other specific forms without departing from the spirit or essential attributes thereof and, accordingly, reference should be made to the appended claims, rather than to the foregoing specification as indicating the scope of the invention.

I claim:

1. A display face, comprising a slice of a display face, said bowling ball including a cross section of a weight block.

2. A display face in accordance with claim 1 wherein clock hands and indicia representing clock numerals are mounted in front of said bowling ball slice.

3. A display face in accordance with claim 1 wherein an award plate is mounted to a portion of said bowling ball slice.

4. A display face in accordance with claim 3 wherein said plate is mounted by threaded fasteners.

5. A display face in accordance with claim 3 wherein said plate is mounted by rivets.

6. A display face in accordance with claim 1 wherein indicia are engraved on said bowling ball slice.

7. A display face in accordance with claim 6 wherein said engraving is at least partially filled with a pigment.

8. A display face in accordance with claim 1 wherein said slice of the bowling ball is polished by sanding.

9. A display face in accordance with claim 8 wherein said polished surface is finished with a wax coating.

10. A display face in accordance with claim 8 wherein said polished surface is finished with a polyurethane coating.

11. A display face in accordance with claim 8 wherein said polished surface is finished with a shellac.

12. A display face in accordance with claim 1 wherein said bowling ball is comprised of materials including a fragrance.

13. A display face in accordance with claim 1 wherein said bowling ball is comprised of material including particles which emit visible light when irradiated.

14. A display face in accordance with claim 13 wherein said particles are florescent particles and said irradiation is black light.

15. A display face in accordance with claim 13 wherein said particles are distributed on the periphery of the bowling ball.

16. A display face in accordance with claim 13 wherein said particles are distributed throughout the bowling ball.

17. A display face in accordance with claim 1 wherein said display face is provided with a peripheral edge wherein the peripheral edge is further shaped.

18. A display face comprising:

a slice of a bowling ball wherein a portion of a weight block of the bowling ball is displayed.

19. A display face in accordance with claim 18 wherein clock hands and indicia representing clock numerals are mounted in front of said bowling ball slice.

20. A display face in accordance with claim 18 wherein an award plate is mounted to a portion of said bowling ball slice.

21. A display face in accordance with claim 20 wherein said plate is mounted by threaded fasteners.

22. A display face in accordance with claim 20 wherein said plate is mounted by rivets.

23. A display face in accordance with claim 18 wherein indicia are engraved on said bowling ball slice.

24. A display face in accordance with claim 23 wherein said engraving is at least partially filled with a pigment.

25. A display face in accordance with claim 18 wherein said slice of the bowling ball is polished by sanding.

26. A display face in accordance with claim 25 wherein said polished surface is finished with a wax coating.

27. A display face in accordance with claim 25 wherein said polished surface is finished with a polyurethane coating.

28. A display face in accordance with claim 25 wherein said polished surface is finished with a shellac.

29. A display face in accordance with claim 18 wherein said bowling ball is comprised of materials including a fragrance.

30. A display face in accordance with claim 18 wherein said bowling ball is comprised of material including particles which emit visible light when irradiated.

31. A display face in accordance with claim 30 wherein said particles are florescent particles and said irradiation is black light.

32. A display face in accordance with claim 30 wherein said particles are distributed on the periphery of the bowling ball.

33. A display face in accordance with claim 30 wherein said particles are distributed throughout the bowling ball.

34. A display face in accordance with claim 18 wherein said display face is provided with a peripheral edge wherein the peripheral edge is further shaped.

* * * * *

UNITED STATES PATENT AND TRADEMARK OFFICE

CERTIFICATE OF CORRECTION

PATENT NO. : 6,831,880 B1
DATED : December 14, 2004
INVENTOR(S) : Ziegler

It is certified that error appears in the above-identified patent and that said Letters Patent is hereby corrected as shown below:

Column 5,
Line 9, delete “display face” after “slice of a” and substitute therefor -- bowling ball --.
Line 10, delete “bowling ball” and substitute therefor -- display face --.

Signed and Sealed this

Eighth Day of February, 2005

JON W. DUDAS
*Director of the United States Patent and Trademark Office*